US010216114B2

(12) United States Patent
Hatano

(10) Patent No.: US 10,216,114 B2
(45) Date of Patent: Feb. 26, 2019

(54) CHARGING DEVICE AND IMAGE FORMING APPARATUS

(71) Applicant: KONICA MINOLTA, INC., Chiyoda-ku, Tokyo (JP)

(72) Inventor: Hokuto Hatano, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/876,355

(22) Filed: Jan. 22, 2018

(65) Prior Publication Data

US 2018/0253024 A1 Sep. 6, 2018

(30) Foreign Application Priority Data

Mar. 1, 2017 (JP) ..... 2017-038199

(51) Int. Cl.
*G03G 15/02* (2006.01)

(52) U.S. Cl.
CPC ..... *G03G 15/0233* (2013.01)

(58) Field of Classification Search
CPC ..... G03G 15/0233
See application file for complete search history.

(56) References Cited

U.S. PATENT DOCUMENTS

2002/0160150 A1* 10/2002 Takahashi ..... B24B 37/28 428/141
2008/0075505 A1* 3/2008 Nagamori ..... G03G 15/0233 399/176
2010/0330475 A1* 12/2010 Tamoto ..... G03G 5/0614 430/56
2017/0038707 A1* 2/2017 Matsunaka ..... G03G 15/206
2017/0205733 A1* 7/2017 Kojiri ..... G03G 15/168

FOREIGN PATENT DOCUMENTS

JP 08044141 A 2/1996

OTHER PUBLICATIONS

Machine Translation of JP H08-044141. Feb. 16, 1996.*

* cited by examiner

*Primary Examiner* — Carla J Therrien
(74) *Attorney, Agent, or Firm* — Holtz, Holtz & Volek PC

(57) ABSTRACT

A charging device is configured to apply electric charge to an image carrier provided outside the charging device. The charging device includes: a cored bar member; and a conductive resin layer provided on a surface of the cored bar member. The conductive resin layer has a film thickness of 200 μm or less. Filtered maximum waviness in an axial direction of the cored bar member is 8 μm or less in a range of a reference length of 60 mm.

6 Claims, 6 Drawing Sheets

FIG.6

| | CONDUCTIVE RESIN LAYER | CORED BAR MEMBER | | | IMAGE QUALITY | |
|---|---|---|---|---|---|---|
| | FILM THICKNESS [μm] | WCM[μm] | WSm[mm] | GRINDING METHOD | OBLIQUE UNEVENNESS | STRIPE NOISE |
| EXAMPLE 1 | 70 | 2.7 | 60 OR MORE | IN-FEED GRINDING | A | A |
| EXAMPLE 2 | 70 | 3.8 | 60 OR MORE | IN-FEED GRINDING | A | A |
| EXAMPLE 3 | 70 | 4.4 | 60 OR MORE | IN-FEED GRINDING | A' | A |
| EXAMPLE 4 | 150 | 2.6 | 60 OR MORE | IN-FEED GRINDING | A | A |
| EXAMPLE 5 | 150 | 3.9 | 60 OR MORE | IN-FEED GRINDING | A | A |
| EXAMPLE 6 | 150 | 4.6 | 60 OR MORE | IN-FEED GRINDING | A' | A |
| EXAMPLE 7 | 190 | 2.6 | 60 OR MORE | IN-FEED GRINDING | A | B |
| EXAMPLE 8 | 190 | 2.6 | 60 OR MORE | IN-FEED GRINDING | A | B |
| EXAMPLE 9 | 70 | 7.3 | 11.8 | THROUGH-FEED GRINDING | B | A |
| EXAMPLE 10 | 70 | 7.8 | 22.9 | THROUGH-FEED GRINDING | B | A |
| COMPARATIVE EXAMPLE 1 | 70 | 10.1 | 31.4 | THROUGH-FEED GRINDING | C | A |
| COMPARATIVE EXAMPLE 2 | 70 | 13.1 | 40.7 | THROUGH-FEED GRINDING | C | A |
| COMPARATIVE EXAMPLE 3 | 250 | 3.1 | 60 OR MORE | THROUGH-FEED GRINDING | A | C |

CHARGING DEVICE AND IMAGE FORMING APPARATUS

The entire disclosure of Japanese Patent Application No. 2017-038199, filed on Mar. 1, 2017, is incorporated herein by reference in its entirety.

BACKGROUND

Technological Field

The present invention relines to a charging device and an image forming apparatus. The image forming apparatus includes an electrophotographic device, a recording device, a display device and the like such as a digital copier, a facsimile and a printer, irrespective of whether color or monochrome.

Description of the Related Art

In an image forming apparatus, a photoreceptor dram serving as a member to be charged is charged in advance to prepare a charged surface, which is subjected to exposure, thereby discharging the electric charge on the exposed portion to form an electrostatic latent image, which is then subjected to processes such as development, transfer onto a transfer paper sheet and fixing, with the result that an image is formed on the transfer paper sheet.

The method used for causing the photoreceptor drum to become charged is as follows. Specifically, a charging device formed of a blade, a brush, a charging roller and the like is used for the photoreceptor drum. The charging roller is brought into contact with the photoreceptor drum, so that the photoreceptor drum becomes charged.

As a charging roller, a thin-layer charging roller has been commonly used. This thin-layer charging roller is a charging roller that is obtained by directly applying a thin conductive layer onto a cored bar. This thin-layer charging roller can be reduced in cost as compared with the conventional thick charging roller having an elastic layer. This thin-layer charging roller has a simple configuration in which only a thin protective layer is provided on the cored bar member. Such a thin-layer charging roller is disclosed in Japanese Laid-Open Patent Publication No. 08-44141.

SUMMARY

In the image forming apparatus including a charging device formed using a thin-layer charging roller, image quality deterioration was observed. Specifically, as image quality deterioration, there is density unevenness that occurs periodically in the oblique direction and is inclined to the image printing direction (oblique density unevenness). As a result of examining the cause of such unevenness, it was found that waviness existing on the surface of the cored bar member causes density unevenness.

It is considered that density unevenness is caused by the following reason. Specifically, in the thin-layer charging roller, when there is large waviness on the surface of the cored bar member, the gap between the thin-layer charging roller and the photoreceptor drum to be charged becomes periodically uneven, which causes poor charging, thereby leading to density unevenness.

The present invention has been made in light of the above-described problems. An object of the present invention is to provide a charging device and an image forming apparatus, by which image quality deterioration caused by a thin-layer charging roller can be suppressed.

To achieve at least one of the abovementioned objects, according to an aspect of the present charging device reflecting one aspect of the present invention is configured to apply electric charge to an image carrier provided outside the charging device. The charging device includes: a cored bar member; and a conductive resin layer provided on a surface of the cored bar member. The conductive resin layer has a film thickness of 200 μm or less. Filtered maximum waviness in an axial direction of the cored bar member is 8 μm or less in a range of a reference length of 60 mm.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 6 is a diagram showing evaluations for the image quality about Examples 1 to 10 and Comparative Examples 1 to 3.

DETAILED DESCRIPTION OF EMBODIMENTS

Figure 1:
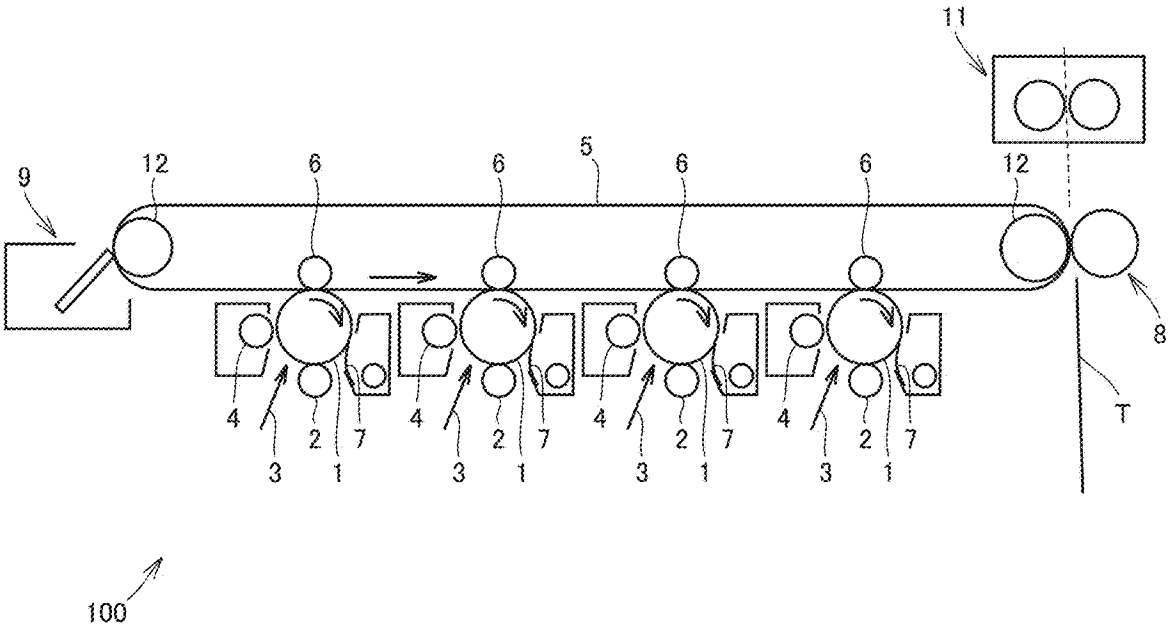
FIG. 1 is a schematic diagram showing the inner configuration of an image forming apparatus in an embodiment.

Hereinafter, one or more embodiments of the present invention will be described with reference to the drawings. However, the scope of the invention is not limited to the disclosed embodiments.

A charging device and an image forming apparatus in the present embodiment will be hereinafter described with reference to the accompanying drawings. In the embodiments described below, when the number, the quantity and the like are mentioned, the scope of the present invention is not necessarily limited thereto unless otherwise specified. Also, the same or corresponding components are designated by the same reference characters, and description thereof will not be repeated. In the accompanying drawings, illustrations are not based on the actual dimensional ratio, and there are some parts shown in different dimensional ratios for clearly illustrating the structure in order to allow easy understanding of the structure.

An image forming apparatus includes a multi function peripheral (MFP) having scanner function, a copying function, a function as a primer, a facsimile function, a data communication function, and a server function.

(Image Forming Apparatus 100)

Referring to FIG. 1, an image forming apparatus 100 in the present embodiment will be hereinafter described. FIG. 1 is a schematic diagram showing the inner configuration of image forming apparatus 100. More specifically, FIG. 1 shows the schematic configuration of a main part functioning in the electrophotographic process in a full-color tandem-type and electrophotographic-type image forming apparatus 100 including a blade cleaning device.

This image forming apparatus 100 is configured to transfer a toner image formed on a photoreceptor drum 1 by the electrophotographic-type image formation process onto a recording medium T such as a sheet of paper, and fix the transferred toner image thereon for image formation.

This image forming apparatus 100 includes photoreceptor drum 1 for forming and carrying an electrostatic latent image on its surface layer. On the periphery of photoreceptor drum 1, there are: a charging device including a thin-layer charging roller 2 formed in a roll shape and contacting the surface of photoreceptor drum 1 in order to allow the surface of photoreceptor drum 1 as an image carrier to become uniformly charged; an exposure device 3 for exposing a portion corresponding to an image on the surface of photoreceptor drum 1 so as to form an electrostatic latent image; a developing device 4 configured to develop the electrostatic latent image on photoreceptor drum 1 by the charged toner through the action of electric field force; a primary transfer roller 6 for transferring the toner image formed on photoreceptor drum 1 onto an intermediate transfer belt 5 through the action of electric field force; and a cleaning device 7 configured to remove untransferred remaining toner on photoreceptor drum 1. The charging device, exposure device 3, developing device 4, primary transfer roller 6, and cleaning device 7 are arranged sequentially along the direction in which photoreceptor drum 1 rotates.

Intermediate transfer belt 5 is supported under the fixed belt tension by support rollers 12 arranged in parallel, thereby forming an intermediate transfer unit. One of support rollers 12 is drive-coupled to a machine body. At the position downstream of primary transfer roller 6 for each color in the direction of movement, a secondary transfer roller 8 is arranged. Secondary transfer roller 8 is configured to transfer toner images in a plurality of colors, which are transferred and layered on intermediate transfer belt 5, onto recording medium T through the action of electric field force.

The toner images transferred onto recording medium T are heated and pressurized by a fixing device 11, and then fixed on recording medium T. The untransferred remaining toner on intermediate transfer belt 5 is cleaned and removed from intermediate transfer belt 5 by an intermediate transfer belt cleaning device 9.

For photoreceptor drum 1, exposure device 3, developing device 4, cleaning device 7, secondary transfer roller 8, fixing device 11, and the like used in this image forming apparatus 100, a well-known electrophotography technique can be optionally selected.

Figure 2:
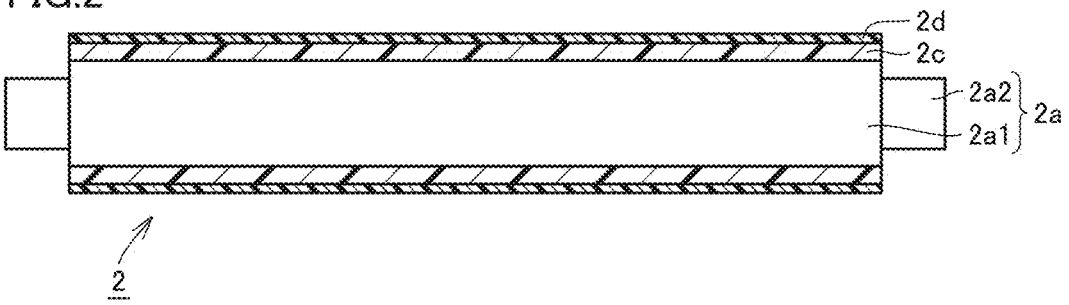
FIG. 2 is a longitudinal cross-sectional view of a thin-layer charging roller in an embodiment.
Figure 3:
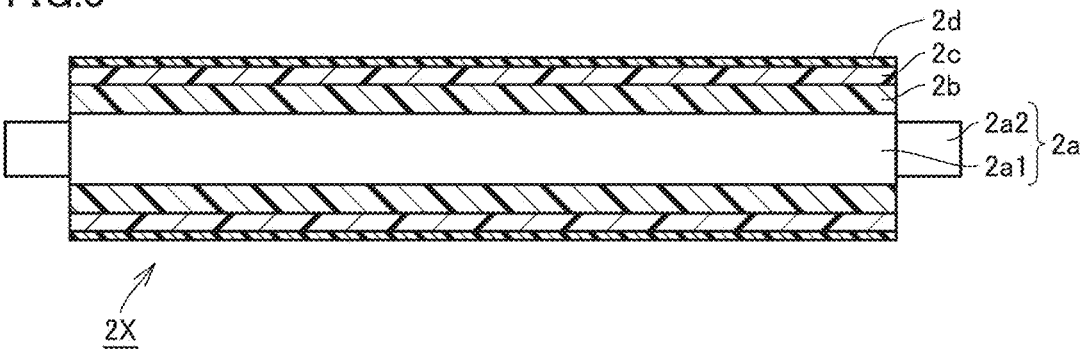
FIG. 3 is a longitudinal cross-sectional view of a conventional thick charging roller.

Referring to FIG. 2, thin-layer charging roller 2 as a charging device will be hereinafter described. FIG. 2 is a longitudinal cross-sectional view of thin-layer charging roller 2. For the purpose of comparison, FIG. 3 shows a longitudinal cross-sectional view of a thick charging roller 2X.

This thin-layer charging roller 2 includes: a resistive layer 2*c* formed to have a uniform thickness on the outer circumferential surface of a cored bar member 2*a*; and a protective layer 2*d* covering the surface of this resistive layer 2*c*. Cored bar member 2*a* has an axial center portion 2*a*1 and an axial end portion 2*a*2 that are formed by mechanical grinding of the surface of a round bar material. Axial end portion 2*a*2 is used as a support point at the time when thin-layer charging roller 2 is supportively fixed and pressed against photoreceptor drum 1.

The material of cored bar member 2*a* is not particularly limited as long as the material is metal that is excellent in conductivity and higher in strength. For example, stainless steel with high corrosion resistance and less fatigue is preferable.

Examples of the surface grinding means for cored bar member 2*a* may be highly precise centerless grinding and cylindrical grinding. As compared with cylindrical grinding, particularly, centerless grinding is often used because it does not require centering and chucking and is also excellent in continuous processability.

Centerless grinding is a method of grinding the surface of a workpiece while adjusting rotation and feed of the workpiece with three-point support by a fixed support blade, a rotating regulating wheel and a grinding wheel. Centerless grinding is roughly classified into two methods including a through-feed grinding method and an in-feed grinding method.

The through-feed grinding method is to continuously grind a workpiece that is being moved in the axial direction by slightly inclining the axial center of the regulating wheel relative to the axial center of the workpiece. According to this method, since grinding is performed simultaneously with movement, grinding unevenness in a spiral shape may occur on the surface of cored bar member 2*a* depending on the conditions.

In thick charging roller 2X shown in FIG. 3, an elastic layer 2*b* is provided between cored bar member 2*a* and resistive layer 2*c*. Accordingly, grinding unevenness occurring on the surface of cored bar member 2*a* does not cause a problem. However, it is considered that thin-layer charging roller 2 in the present embodiment may cause density unevenness in accordance with grinding unevenness.

On the other hand, in the in-feed grinding method, a regulating wheel and a grinding wheel are longer than a cored bar, and grinding is performed without moving the cored bar. In this case, since movement does not occur during grinding, grinding unevenness in a spiral shape as occurring in the through-feed grinding method does not occur.

Figure 4:
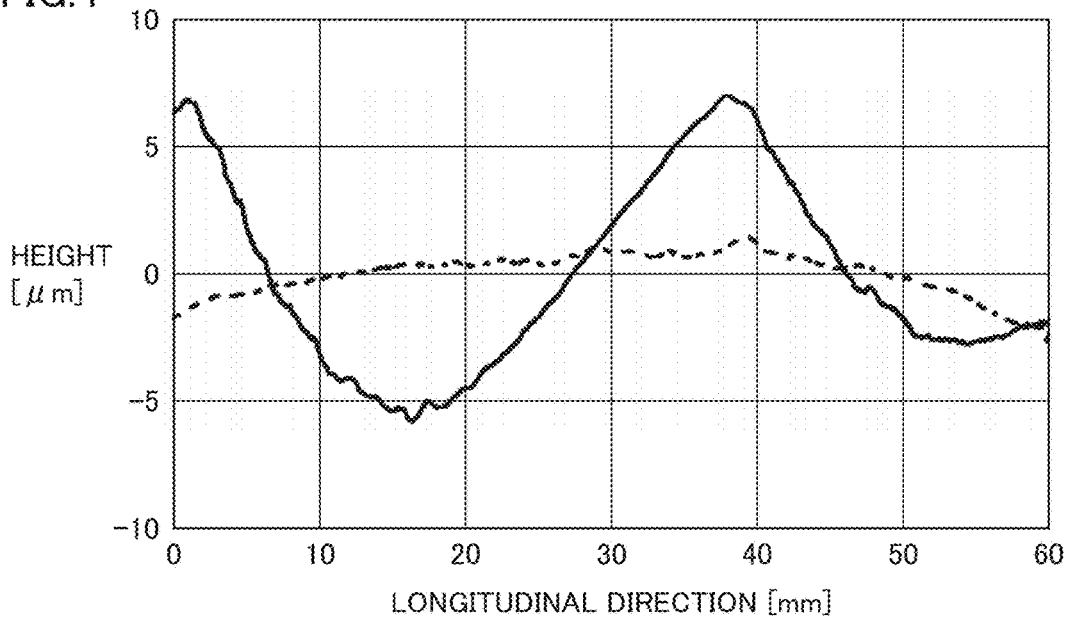
FIG. 4 is a diagram showing waviness curves obtained when a cored bar member is subjected to through-feed centerless grinding (solid line) and in-feed grinding (dashed line).

FIG. 4 shows waviness curves obtained when cored bar member 2*a* is subjected to through-feed centerless grinding (solid line) and in-feed grinding (dashed line). Waviness was measured in the axial direction (longitudinal direction) of axial center portion 2*a*1 of cored bar member 2*a* using SURFCOM 480A manufactured by Tokyo Seimitsu Co. Ltd., in the filtered waviness measurement mode at a cutoff wavelength of 0.8 mm and at a measuring speed of 0.3 mm/s. The reference length was set at 60 mm. When the reference length is too short, waviness cannot be detected. When the reference length is too long, if cored bar member 2*a* has a crown shape, this crown shape causes noise, so that waviness that influences density unevenness cannot be detected.

As shown by a solid line in FIG. 4, cored bar member 2*a* subjected to through-feed grinding exhibits periodical waviness with large amplitude in the longitudinal direction, in which the filtered maximum waviness (WCM) in the axial direction of cored bar member 2*a* was 13.075 μm, and the waviness cycle WSm was 40.715 mm. Thin-layer charging roller 2 formed using cored bar member 2*a* subjected to through-feed grinding was mounted as a charging device on the image forming apparatus (bizhub C287 manufactured by Konica Minolta, Inc.). Then, a halftone image was actually output. The results are shown in FIG. 5.

Figure 5:
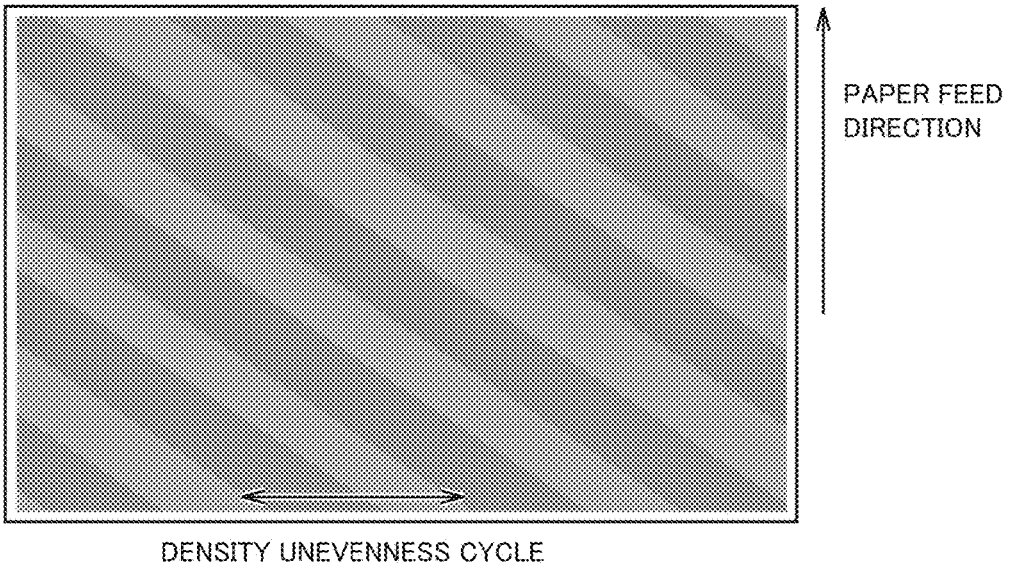
FIG. 5 is a diagram showing an example of oblique density unevenness.

As shown in FIG. 5, density unevenness in the oblique direction occurs. This density unevenness is inclined to the paper feed direction. The cycle of this density unevenness approximately matches with the filtered maximum waviness (WCM) of the cored bar that has been subjected to through-feed grinding. When the filtered maximum waviness (WCM) of cored bar member 2*a* is relatively large, uneven contact with photoreceptor drum in the longitudinal direction periodically occurs, which is ultimately detected as oblique density unevenness due to a periodic difference in charging performance.

On the other hand, as shown by a dashed line in FIG. 4, cored bar member 2*a* subjected to in-feed grinding does not exhibit periodical waviness in the case of a reference length of 60 mm. In this case, the filtered maximum waviness (WCM) is also as small as 3.838 mm. As to thin-layer charging roller 2 formed using this cored bar member 2*a* having been subjected to in-feed grinding, the resulting image was also similarly checked, but oblique density unevenness as shown in FIG. 5 was not detected.

Resistive layer 2*c* is formed for suppressing resistance unevenness. Resistive layer 2*c* is formed of a thermoplastic resin composition in which a polymer-type ion conductive agent is dispersed. Examples of a thermoplastic resin composition may be general-purpose resins such as polyethylene, polypropylene, polymethyl methacrylate, polystyrene, and copolymer thereof.

A polymer-type ion conductive material is preferably a polymer compound containing a polyether ester amide component. Polyether ester amide is an ion conductive polymer material, and uniformly dispersed and fixed at the molecular level in a matrix polymer. This prevents variations in resistance value that are caused by poor dispersion as found in the composition in which electron conducting-type conductive agent such as metal oxide and carbon black is dispersed. Also, due to a polymer material, bleedout is less likely to occur.

Resistive layer 2*c* is formed on cored bar member 2*a* by the coating method such as dipping, spray coating or a roll coating for coating a solution prepared by dissolving the above-described materials in an organic solvent. Resistive layer 2*c* is formed to have a thickness of 170 μm or less, preferably 120 μm or less, and further preferably 70 μm or less. This is because thicker resistive layer 2*c* is more likely to cause coating unevenness of resistive layer 2*c*, which leads to density unevenness.

Protective layer 2*d* is provided for preventing contamination by a developer and paper powder. A resin material is suitable as a material for forming protective layer 2*d* since the resin material is excellent in film forming performance. As a resin material, it is preferable to use a fluororesin, a polyamide resin, a polyester resin, or a polyvinyl acetal resin since these resins are excellent in non-adhesiveness and can prevent adhesion of toner.

Resin materials generally have electric insulation properties. Accordingly, when protective layer 2*d* is formed of a resin material alone, the characteristics of the charging roller are not satisfied. Thus, conductive agents such as metal oxide and carbon black are dispersed in the above-described resin material, thereby adjusting the resistance value of protective layer 2*d*.

In order to improve the adhesiveness between protective layer 2*d* and resistive layer 2*c*, a reactive curing agent such as isocyanate may be dispersed in the resin material.

Protective layer 2*d* is formed using the coating method such as dipping as in the case of resistive layer 2*c*. The film thickness of protective layer 2*d* is preferably about 5 μm to 30 μm, and for the purpose of achieving uniform film thickness, more preferably 10 μm to 20 μm.

Regarding the film thickness of the conductive layer as thin-layer charging roller 2, it is preferable that the sum total of the thickness of resistive layer 2*c* and the thickness of protective layer 2*d* is 200 μm or less, further preferably 150 μm or less, and still further preferably 100 μm or less. This is because the thicker conductive layer is more likely to cause film thickness unevenness, which leads to density unevenness. In terms of uniform charging, it is preferable that the surface roughness is 10 μm or less in ten-point average roughness Rzjis defined in JIS B0601: 2001.

EXAMPLES

An image forming apparatus as a test machine was used to check the image quality of a halftone image. The image quality was evaluated by checking whether oblique unevenness occurred or not, and whether stripe noise occurred or not. As a test machine, a charging unit of bizhub C287 manufactured by Konica Minolta, Inc. was modified, on which thin-layer charging roller 2 shown in FIG. 2 was installed.

As an experiment method, a charge input voltage Vc was set such that an electric potential (Vo) of photoreceptor drum 1 was set at −500V, and the voltage applied to developing device 4 and the output to exposure device 3 were adjusted so as to achieve the concentration as prescribed for the test machine. Then, a halftone image was output.

FIG. 6 shows the evaluation conditions and the results of the image quality. FIG. 6 shows Examples 1 to 10 and Comparative Examples 1 to 3. The conditions not shown in FIG. 6 are as follows.

The reference length of the filtered maximum waviness (WCM) in the axial direction of cored bar member 2*a* is 60 mm. The evaluation environment is an NN environment at 20 degrees and at 50% RH. Cored bar member 2*a* is prepared using SUS304, axial center portion 2*a*1 has a diameter of 12 mm, and axial end portion 2*a*2 has a diameter of 8 mm.

In FIG. 6, the film thickness [μm] of the conductive resin layer indicates the total film thickness of protective layer 2*d* and resistive layer 2*c*, in each of Examples and Comparative Examples, the film thickness [μm] of protective layer 2*d* is 10 [μm] and the remaining film thickness corresponds to the film thickness [μm] of resistive layer 2*c*.

The image quality was evaluated as described below. The image quality was evaluated by checking whether "oblique unevenness" occurred or not, and whether "vertical stripe noise" occurred or not.

As to "oblique unevenness", a high density portion and a low density portion were visually checked to make evaluations by a color difference δE therebetween. Color difference meter CR-400 manufactured by Konica Minolta, Inc. was used for measurement. The evaluation criteria are as follows, in which C is defined as an NG level.

At an evaluation rank "A", color difference δE is shown as $\delta E < 0.5$, in which the visual observation level shows that color difference δE cannot completely be visually observed. At on evaluation rank "A'", color difference δE is shown as $0.5 \leq \delta E < 1$, in which the visual observation level shows that color difference δE cannot almost he visually observed, but can be partially visually observed by intense gazing. At an evaluation rank "B", color difference δE is shown as $1 \leq \delta E < 2$, in which the visual observation level shows that color difference δE cannot almost be visually observed, but a boundary line can be visually observed by intense gazing. At an evaluation rank "C", color difference δE is shown as $2 \leq \delta E$, in which color difference δE can be visually observed, which is defined as a failure.

The "vertical stripe noise" was checked and determined through visual observation whether such a "vertical stripe noise" occurred or not. At an evaluation rank "A", the visual observation level shows that the vertical stripe noise cannot completely be visually observed. At an evaluation rank "B", the visual observation level shows that the vertical stripe noise cannot almost be visually observed, but can be partially visually observed by intense gazing (a length less than 0.5 mm). At an evaluation rank "C", the visual observation level shows that the vertical stripe noise can be visually observed, which is defined as a failure.

(Method of Manufacturing Cored Bar Member 2*a*)

Cored bar member 2*a* in Example 1 was ground by an in-feed centerless grinding apparatus. Specifically, cored bar member 2*a* was prepared using a round bar material processed by continuous pultrusion and having a diameter of 12 mm. A grinding wheel having a diameter of 610 mm and a length of 405 mm was used. The rotation speed was set at 20 rpm. A regulating wheel having a diameter of 320 mm and a length of 405 mm was used.

In contrast to the conditions for Example 1, in Examples 2 and 5, the rotation speed of the grinding wheel was set at 2.5 rpm. In contrast to the conditions for Example 1, in Examples 3 and 6, the rotation speed of the grinding wheel was set at 30 rpm. In Examples 4, 7 and 8 and Comparative Example 3, the same manufacturing conditions as those for Example 1 were employed.

Cored bar member 2*a* in Example 9 was ground by the through-feed centerless grinding apparatus. Specifically, cored bar member 2*a* was prepared using a pultruded cored bar member having a diameter of 12 mm. A grinding wheel having a diameter of 610 mm and a length of 150 mm was used. The rotation speed was set at 20 rpm. A regulating wheel having a diameter of 320 mm and a length of 150 mm was used and set at an angle of 1 degree.

In contrast to the conditions for Example 9, in Example 10, the rotation speed of the grinding wheel was set at 40 rpm. In contrast to the conditions for Example 9, in Comparative Example 1, the rotation speed of the grinding wheel was set at 60 rpm. In contrast to the conditions for Example 9, in Comparative Example 2, the rotation speed of the grinding wheel was set at 80 rpm.

The following is an explanation about the technical meaning that not only "filtered maximum waviness (WCM)" but also "waviness curve element average length (WSm)" was defined on the conditions for cored bar member 2*a*. When the "waviness curve element average length (WSm)" within the measurement length of 60 mm is relatively small, cored bar member 2*a* is to potentially have waviness. Thus, when the film thickness of the surface layer formed on cored bar member 2*a* is relatively thick, the surface layer is more likely to be formed in a shape along such waviness.

Accordingly, it is considered that, when the "waviness curve element average length (WSm)" of the cored bar member is relatively large, the surface waviness may be further increased by formation of the surface layer, thereby deteriorating "oblique unevenness".

FIG. 6 shows evaluation results. Based on the results, in the case where the film thickness of the conductive resin layer formed on the surface of cored bar member 2*a* was 200 μm or less, when the "filtered maximum waviness (WCM)" was 8 μm or less in the range of the reference length of 60 mm irrespective of whether "in-feed centerless grinding" or "through-feed centerless grinding", excellent image evaluations were obtained regarding both "oblique unevenness" and "stripe noise" evaluated for image quality (Examples 1 to 10).

Furthermore, based on the results, more excellent image evaluations were obtained when the "filtered maximum waviness (WCM)" was 6.5 μm or less in the range of the reference length of 60 mm (Examples 1 to 8). Furthermore, based on the results, more excellent image evaluations were obtained when the "filtered maximum waviness (WCM)" was 64.6 μm or less in the range of the reference length of 60 mm (Examples 1 to 6).

It could also be confirmed based on the results that, when cored bar member 2*a* was manufactured by "in-feed centerless grinding", the evaluations for "oblique unevenness" were higher than those in the case of "through-feed centerless grinding" (Examples 1 to 8).

It could be also confirmed based on the results that, when the "waviness curve element average length (WSm)" of cored bar member 2*a* was in the range of the reference length of 60 mm, the evaluations for the reference length of 60 mm or more were higher than the evaluations for the reference length of less than 60 mm (Examples 1 to 8).

Thus, according to thin-layer charging roller 2 in the present embodiment and the image forming apparatus formed using; this thin-layer charging roller 2, the filtered maximum waviness (WCM) on the surface of cored bar member 2*a* is defined, so that an image having excellent image quality can be achieved.

As described above, the present charging device is configured to apply electric charge to an image carrier provided outside the charging device. The charging device includes: a cored bar member; and a conductive resin layer provided on a surface of the cored bar member. The conductive resin layer has a film thickness of 200 μm or less. Filtered maximum waviness in an axial direction of the cored bar member is 8 μm or less in a range of a reference length of 60 mm.

In another embodiment, a waviness curve element average length in the axial direction of the cored bar member is 60 mm or more in the range of the reference length of 60 mm.

In another embodiment, the filtered maximum waviness in the axial direction of the cored bar member is 6.5 μm or less in the range of the reference length of 60 mm.

In another embodiment, the filtered maximum waviness in the axial direction of the cored bar member is 4 μin or less in the range of the reference length of 60 mm.

In another embodiment, the conductive resin layer includes a resistive layer provided on the surface of the cored bar member, and a protective layer provided on a surface of the resistive layer.

In another embodiment, the cored bar member is formed in a roll shape, and contacts the image carrier.

This image forming apparatus includes: an image carrier; and a charging device configured to apply electric charge to the image carrier. The charging device is the charging device described in the above.

Although embodiments of the present invention have been described and illustrated in detail, the disclosed embodiments are made for purposes of illustration and example only and not limitation. The scope of the present invention should be interpreted by terms of the appended claims.

What is claimed is:

1. A charging device configured to apply electric charge to an image carrier provided outside the charging device, the charging device comprising:

a cored bar member; and a conductive resin layer provided on a surface of the cored bar member, wherein:

the conductive resin layer has a film thickness of 200 μm or less, filtered maximum waviness in an axial direction of the cored bar member is 8 μm or less in a range of 60 mm, and a waviness curve element average length in the axial direction of the cored bar member is 60 mm or more in the range of 60 mm.

2. The charging device according to claim 1, wherein the filtered maximum waviness in the axial direction of the cored bar member is 6.5 μm or less in the range of 60 mm.

3. The charging device according to claim 2, wherein the filtered maximum waviness in the axial direction of the cored bar member is 4 μm or less in the range of 60 mm.

4. The charging device according to claim 1, wherein the conductive resin layer includes:

a resistive layer provided on the surface of the cored bar member, and a protective layer provided on a surface of the resistive layer.

5. The charging device according to claim 1, wherein the cored bar member is formed in a roll shape, and contacts the image carrier.

6. An image forming apparatus comprising:

an image carrier; and a charging device configured to apply electric charge to the image carrier, the charging device being the charging device according to claim 1.

* * * * *